US010753587B1

(12) United States Patent
Liang et al.

(10) Patent No.: US 10,753,587 B1
(45) Date of Patent: Aug. 25, 2020

(54) MULTIPURPOSE ILLUMINATING DEVICE FOR AUTO DETAILING COMPRISING THREE ILLUMINATING ELEMENTS AND THREE CORRESPONDING ADJUSTMENT SWITCHES

(71) Applicants: Hung-Fu Liang, Keelung (TW); Wei-Hsin Chuang, Changhua County (TW); Tzu-Yu Lee, New Taipei (TW); Chao-Ching Lee, Taipei (TW)

(72) Inventors: Hung-Fu Liang, Keelung (TW); Wei-Hsin Chuang, Changhua County (TW); Tzu-Yu Lee, New Taipei (TW)

(73) Assignees: Hung-Fu Liang, Keelung (TW); Wei-Hsin Chuang, Changhua County (TW); Tzu-Yu Lee, New Taipei (TW); Chao-Ching Lee, Taipei (TW)

( * ) Notice: Subject to any disclaimer, the term of this patent is extended or adjusted under 35 U.S.C. 154(b) by 0 days.

(21) Appl. No.: 16/829,312

(22) Filed: Mar. 25, 2020

(30) Foreign Application Priority Data

Apr. 24, 2019 (TW) ..... 108205054 U

(51) Int. Cl.

| | |
|---|---|
| ***F21V 21/30*** | (2006.01) |
| ***F21S 9/02*** | (2006.01) |
| ***F21V 14/02*** | (2006.01) |
| ***B25H 5/00*** | (2006.01) |
| ***F21V 23/04*** | (2006.01) |

(52) U.S. Cl.
CPC ..... *F21V 21/30* (2013.01); *B25H 5/00* (2013.01); *F21S 9/02* (2013.01); *F21V 14/025* (2013.01); *F21V 23/0414* (2013.01)

(58) Field of Classification Search
CPC ..... F21V 21/28; F21V 21/29; F21V 21/30; F21V 23/0414; F21V 21/096; F21V 21/0965; B25H 5/00; F21W 2131/402; F21W 2131/403
See application file for complete search history.

(56) References Cited

U.S. PATENT DOCUMENTS

| | | | | |
|---|---|---|---|---|
| 9,127,831 | B2 * | 9/2015 | Watanabe | F21V 23/04 |
| 2015/0247628 | A1 * | 9/2015 | Li | F21L 4/005 362/183 |
| 2017/0205058 | A1 * | 7/2017 | Ostrander | B60Q 3/35 |

* cited by examiner

*Primary Examiner* — Robert J May
(74) *Attorney, Agent, or Firm* — Muncy, Geissler, Olds & Lowe, P.C.

(57) ABSTRACT

A multipurpose illuminating device for auto detailing includes a main body, a control module and a lighting fixture. The main body has a fixed end and an illumination end oppositely disposed to each other, where the fixed end is used for fixedly connecting a machine tool or a platform. The control module, disposed at the main body, includes a first adjustment switch, a second adjustment switch and a third adjustment switch. The lighting fixture includes a multi-angle bending assembly and a lighting assembly. The multi-angle bending assembly is rotationally fixed to the illumination end. The lighting assembly is connected with the multi-angle bending assembly, and coupled electrically with the control module for controlling the light beams.

15 Claims, 10 Drawing Sheets

MULTIPURPOSE ILLUMINATING DEVICE FOR AUTO DETAILING COMPRISING THREE ILLUMINATING ELEMENTS AND THREE CORRESPONDING ADJUSTMENT SWITCHES

This application claims the benefit of Taiwan Patent Application Serial No. 108205054, filed Apr. 24, 2019, the subject matter of which is incorporated herein by reference.

BACKGROUND OF THE INVENTION

(1) Field of the Invention

The invention relates to a multipurpose illuminating device for auto detailing, and more particularly to the multipurpose illuminating device for auto detailing that can utilize a plurality of adjusting switches to control individual light intensities of corresponding lighting elements.

(2) Description of the Prior Art

In the current field of auto detailing (or car detailing), when a car detailing worker or an ordinary people wants to have a vehicle to be polished, derusted, mended, painted, waxed or cleaned, the vehicle surface is usually irradiated with the natural light or indoor lights, and the naked eyes are directly used to inspect if any addition work is needed. In particular, in the case that the light is dim, the worker usually needs to approach himself or herself to the vehicle surface for a final check. However, such an inspection method may encounter a shortcoming that some tiny defects are unable to be located, affect the detailing performance, and increase body burden of the worker.

As described above, in order to resolve the aforesaid problems caused by insufficient illumination, most of the workers would prefer to choose indoor lights with stronger brightness, to add additional upright lamps, or even to use a handheld lamp while in auto detailing. Nevertheless, there are still some places failed to be covered by these indoor lights. Though the upright lamp can provide sufficient short-distance illumination, yet the associated movement and angular adjustment are less convenient. On the other hand, the handheld lamp can resolve the shortages in illumination and angling to some degree, but the worker needs a free hand to handle the handheld lamp. Namely, only one hand is left for manipulating the machine tool for detailing. Obviously, inconvenience and additional burden to the worker are inevitable.

SUMMARY OF THE INVENTION

In the art, while in performing auto detailing, the natural light or indoor lights are usually applied for irradiating the vehicle surface, and then the naked eyes are used for final inspection. Thereupon, the shortcoming of insufficient illumination is usually met, and conventionally an upright lamp or a handheld lamp is used for adding the brightness. However, the problem of insufficient illumination is anyhow still remained, and further accompanied with inevitable difficulties in angular adjustment and manual manipulation. Accordingly, it is an object of the present invention to provide a multipurpose illuminating device for auto detailing that can be arbitrarily fixed to the vehicle surface or the machine tool for detailing, adjust the projection angle easily, and enhance the use convenience.

In this invention, a multipurpose illuminating device for auto detailing includes a main body, a control module and a lighting fixture.

The main body has a fixed end and an illumination end oppositely disposed to each other, in which the fixed end is used for fixedly connecting a machine tool or a platform, and the illumination end is formed by extending from the fixed end in a first direction.

The control module is disposed at the main body, and includes a first adjustment switch, a second adjustment switch and a third adjustment switch. The first adjustment switch is used for being adjusted to generate a first strength-adjusting signal. The second adjustment switch is used for being adjusted to generate a second strength-adjusting signal. The third adjustment switch is used for being adjusted to generate a third strength-adjusting signal.

The lighting fixture includes a multi-angle bending assembly and a lighting assembly. The multi-angle bending assembly is rotationally fixed to the illumination end. The lighting assembly is connected with the multi-angle bending assembly, and coupled electrically with the control module. The lighting assembly includes a first illuminating element, a second illuminating element and a third illuminating element. The first illuminating element is used for projecting a first light beam, and the first light beam has a first luminous field and a first light intensity. The first light intensity is adjusted by the first strength-adjusting signal. The second illuminating element is used for projecting a second light beam, and the second light beam has a second luminous field and a second light intensity. The second luminous field overlaps the first luminous field, and the second light intensity is adjusted by the second strength-adjusting signal. The third illuminating element is used for projecting a third light beam, and the third light beam has a third luminous field and a third light intensity. The third luminous field overlaps the first luminous field and the second luminous field, and the third light intensity is adjusted by the third strength-adjusting signal.

In one embodiment of the present invention, the first strength-adjusting signal, the second strength-adjusting signal and the third strength-adjusting signal are all voltage level signals.

In one embodiment of the present invention, the multipurpose illuminating device for auto detailing further includes a rechargeable battery, and the rechargeable battery is coupled electrically with the control module and used for energizing the control module.

Preferably, the multipurpose illuminating device for auto detailing further includes a power detection module, wherein the power detection module is coupled electrically with the rechargeable battery and the control module, and used for detecting a power storage of the rechargeable battery and for generating and sending a power detection signal to the control module. In addition, multipurpose illuminating device for auto detailing further includes a power display unit, wherein the power display unit is coupled electrically with the control module, and controls the power display unit to display the power storage of the rechargeable battery according to the power detection signal.

In one embodiment of the present invention, the multipurpose illuminating device further includes a universal fixed structure rotationally connected to the fixed end. Preferably, the universal fixed structure further includes a universal head and a magnetic element, the universal head is rotationally connected to the fixed end, and the magnetic element is fixedly connected to the universal head. In addition, the fixed end is furnished with a universal head connector, and the universal head is rotationally disposed at the universal head connector.

In one embodiment of the present invention, the multipurpose illuminating device for auto detailing further includes a magnetic element fixedly connected to fixed end.

In one embodiment of the present invention, the multi-angle bending assembly includes a first connector, a second connector and a third connector. The first connector is connected with the illumination end. The second connector has a first connection end and a second-connector end portion disposed oppositely to each other, and the first connection end is rotationally connected with the first connector. The third connector is rotationally connected to the second-connector end portion, and the lighting assembly is connected with the third connector.

Preferably, the first connector has at least one peripheral guide structure, the illumination end is furnished with a rotation-limiting structure, and the rotation-limiting structure is protruded into the peripheral guide structure to have the first connector able to swing with respect to the illumination end in a limited range.

Preferably, the first connector has a first arc guide, the first connection end is furnished with a first swing-limiting structure, and the first swing-limiting structure is protruded into the first arc guide to have the second connector able to swing with respect to the first connector in a limited range.

Preferably, the first connector further has a plurality of first swing-positioning grooves, the first connection end is further furnished with at least one first positioning rib, and the at least one first positioning rib is buckled with at least one of the plurality of first swing-positioning grooves.

Preferably, the third connector has a second arc guide, the second-connector end portion is furnished with a second swing-limiting structure, and the second swing-limiting structure is protruded into the second arc guide to have the third connector able to swing with respect to the second connector in a limited range.

Preferably, the third connector further has a plurality of second swing-positioning grooves, the second-connector end portion is further furnished with at least one second positioning rib, and the at least one second positioning rib is buckled with at least one of the plurality of second swing-positioning grooves.

As stated, in the multipurpose illuminating device for auto detailing provided by this invention, the first adjustment switch, the second adjustment switch and the third adjustment switch provided in this invention can control the first illuminating element, the second illuminating element and the third illuminating element, respectively, so as able to adjust the first light intensity of the first light beam, the second light intensity of the second light beam, and the third light intensity of the third light beam for achieving a satisfied working environment with sufficient brightness for auto detailing. In addition, since the fixed end of the multipurpose illuminating device for auto detailing can be fixedly connected to the machine tool or adhered to the platform, thus great convenience for auto detailing can be obtained.

All these objects are achieved by the multipurpose illuminating device for auto detailing described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a multipurpose illuminating device for auto detailing. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
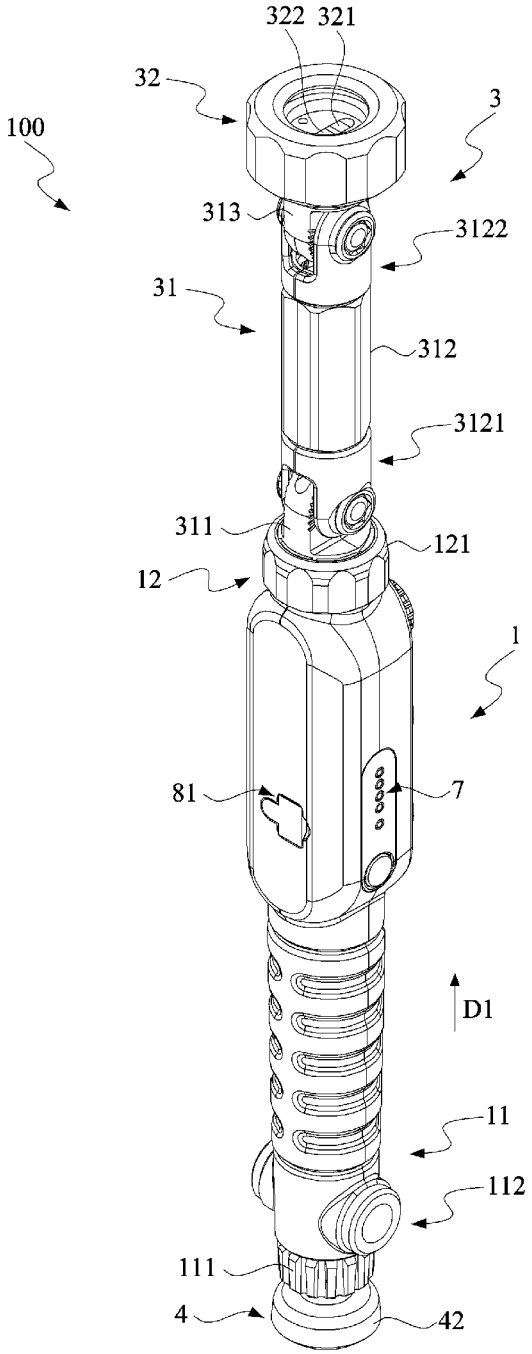
FIG. 1 is a schematic perspective view of a first embodiment of the multipurpose illuminating device for auto detailing in accordance with the present invention.
Figure 2:
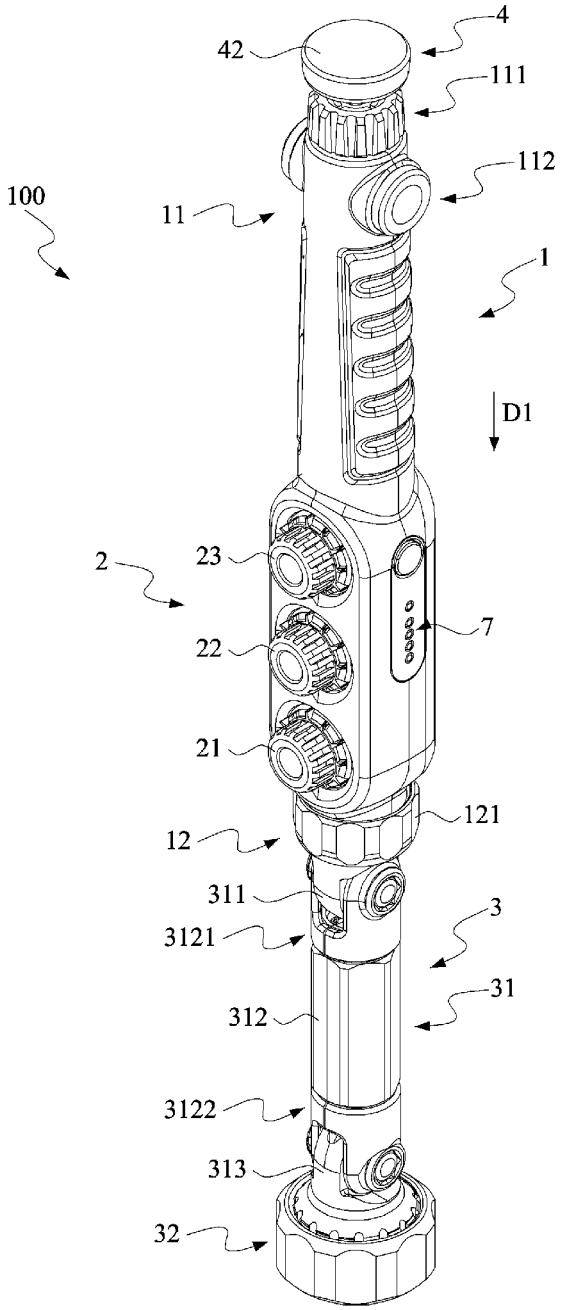
FIG. 2 is another view of FIG. 1.
Figure 3:
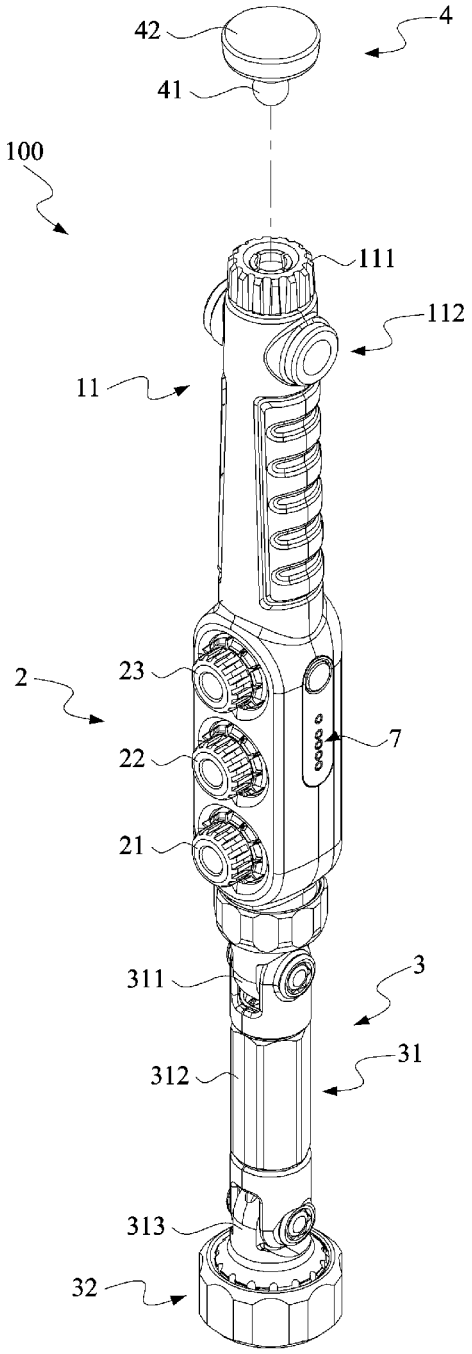
FIG. 3 is a schematic exploded view of FIG. 2, with the universal fixed structure separated from the illuminating device.
Figure 4:
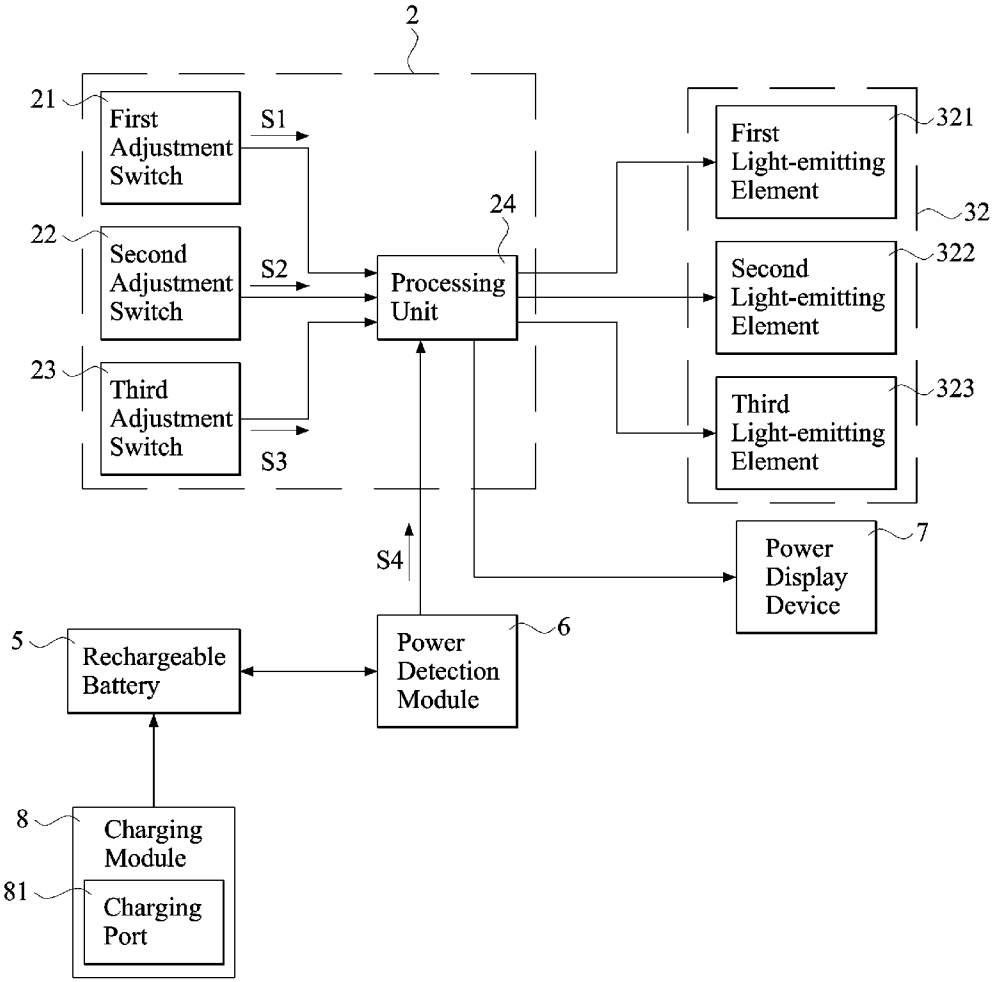
FIG. 4 is a schematic block view of the first embodiment of FIG. 1.

Refer now to FIG. 1 through FIG. 4; where FIG. 1 is a schematic perspective view of a first embodiment of the multipurpose illuminating device for auto detailing in accordance with the present invention, FIG. 2 is another view of FIG. 1, FIG. 3 is a schematic exploded view of FIG. 2 with the universal fixed structure separated from the illuminating device, and FIG. 4 is a schematic block view of the first embodiment of FIG. 1.

As shown in FIG. 1 to FIG. 4, the multipurpose illuminating device for auto detailing 100 includes a main body 1, a control module 2 and a lighting fixture 3, a universal fixed structure 4, a rechargeable battery 5, a power detection module 6, a power display unit 7 and a charging module 8.

The main body 1 has a fixed end 11 and an illumination end 12 disposed oppositely to the fixed end 11. The fixed end 11 has a universal head connector 111 and a screw connector 112. In this embodiment, the universal head connector 111 is actually consisted of four clamp fingers (not labeled in the figure) and a tightening ring (not labeled in the figure). With the tightening ring to shrink or expand these four clamp fingers, this universal head connector 111 can be used for fixedly holding an object.

The illumination end 12 is extended in a first direction D1 from the fixed end 11, and furnished with a screw cap 121.

The control module 2, disposed at the main body 1, includes a first adjustment switch 21, a second adjustment switch 22, a third adjustment switch 23 and a processing unit 24. The first adjustment switch 21 is used for being adjusted to generate a first strength-adjusting signal S1, the second adjustment switch 22 is used for being adjusted to generate a second strength-adjusting signal S2, and the third adjustment switch 23 is used for being adjusted to generate a third strength-adjusting signal S3. The processing unit 24, coupled electrically with the first adjustment switch 21, the second adjustment switch 22 and the third adjustment switch 23, is used for receiving and further analyzing the first strength-adjusting signal S1, the second strength-adjusting signal S2 and the third strength-adjusting signal S3.

In this embodiment, the first adjustment switch 21, the second adjustment switch 22 and the third adjustment switch 23 can be knobs, and the first strength-adjusting signal S1, the second strength-adjusting signal S2 and the third strength-adjusting signal S3 are all voltage level signals. Thereupon, the user can rotate the knob to generate a relevant voltage signal to account for a specific voltage level. However, in some other embodiments, the first adjustment switch 21, the second adjustment switch 22 and the third adjustment switch 23 can be embodied as levers to undergo linear displacements for generating the first strength-adjusting signal S1, the second strength-adjusting signal S2 and the third strength-adjusting signal S3. Further, in detail, the aforesaid knob or lever can be integrated with an electronic device having variable resistance, so that the knob or lever can be used to adjust the voltage level so as to produce a corresponding voltage level signal.

The lighting fixture 3 includes a multi-angle bending assembly 31 and a lighting assembly 32. The multi-angle bending assembly 31 includes a first connector 311, a second connector 312 and a third connector 313. The first connector 311 is fixedly connected to the illumination end 12 via a screw cap 121. The second connector 312 has a first connection end 3121 and a second-connector end portion 3122, in which the first connection end 3121 is rotationally connected with the first connector 311, and the second-connector end portion 3122 is integrated with the first connection end 3121 as a unique piece. The third connector 313 is rotationally connected with the second-connector end portion 3122.

Figure 5:
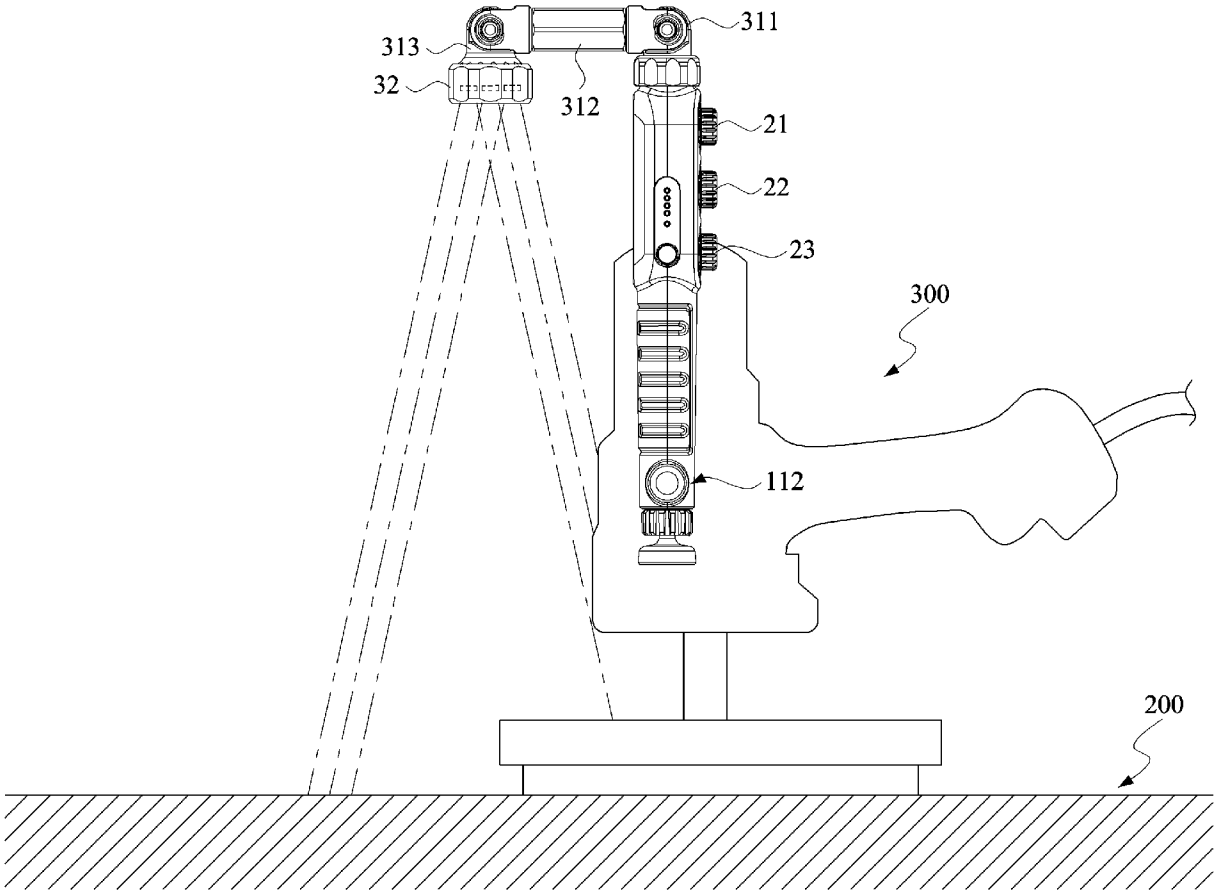
FIG. 5 demonstrates schematically an application of the first embodiment of FIG. 1.
Figure 6:
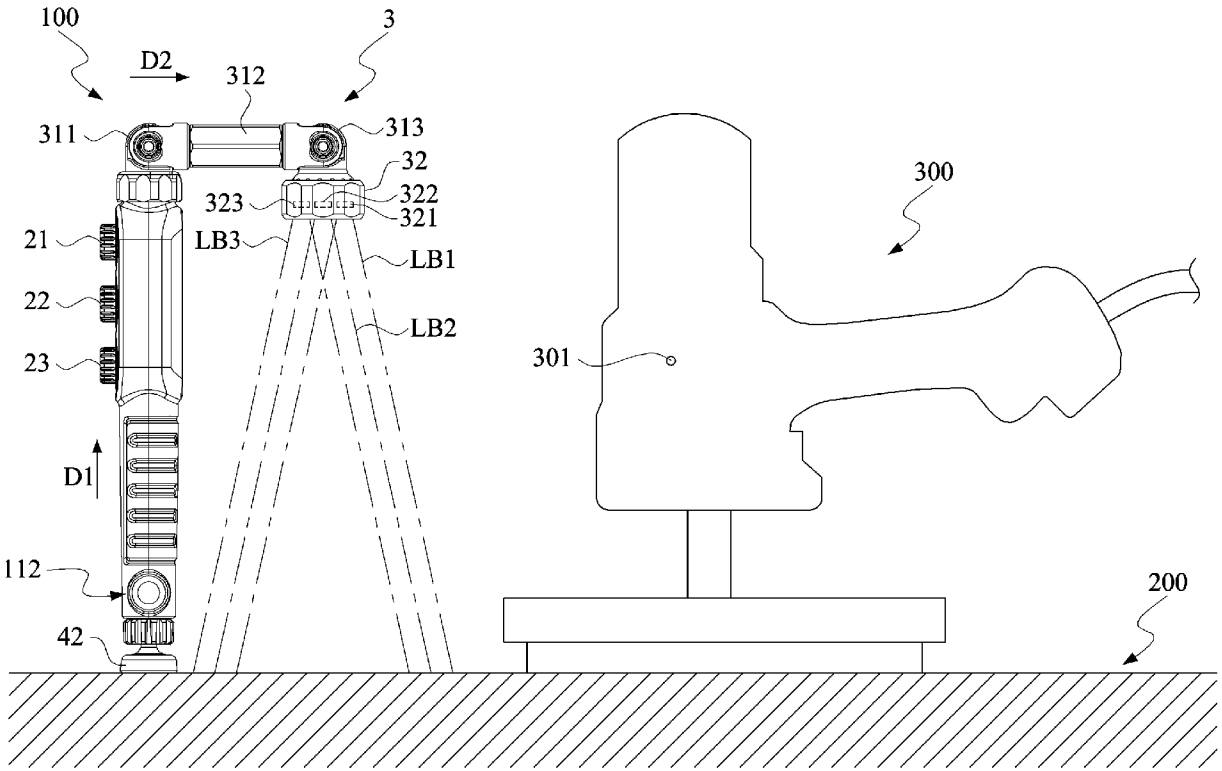
FIG. 6 demonstrates schematically another application of the first embodiment of FIG. 1.

Refer now to FIG. 1, and FIG. 3 through FIG. 6, where FIG. 5 demonstrates schematically an application of the first embodiment of FIG. 1, while FIG. 6 demonstrates schematically another application of the first embodiment of FIG. 1. As shown, the lighting assembly 32, fixedly connected to the third connector 313, has a first illuminating element 321, a second illuminating element 322 and a third illuminating element 323.

The first illuminating element 321, the second illuminating element 322 and the third illuminating element 323 are all coupled electrically with the processing unit 24. The first illuminating element 321 is used for projecting a first light beam LB1 defined with a first luminous field and a first light intensity. The first light intensity is adjusted by the processing unit 24, according to the first strength-adjusting signal S1. The second illuminating element 322 is used for projecting a second light beam LB2 defined with a second luminous field and a second light intensity. The second luminous field overlaps the first luminous field, and the second light intensity is controlled by the processing unit 24 according to the second strength-adjusting signal S2. The third illuminating element 323 is used for projecting a third light beam LB3 defined with a third luminous field and a third light intensity. The third luminous field overlaps both the first luminous field and the second luminous field, and the third light intensity is regulated by the processing unit 24 according to the third strength-adjusting signal S3. In this embodiment, since the first luminous field, the second luminous field and the third luminous field are all overlapped partially, and thus when any two of the first illuminating element 321, the second illuminating element 322 and the third illuminating element 323 are lighted up, the corresponding two of the first light beam LB1, the second light beam LB2 and the third light beam LB3 would be integrated to form a combined illumination beam. However, in this embodiment, the first light beam LB1, any of the second light beam LB2 and the third light beam LB3 can be solely used as an illumination beam.

As described above, in this embodiment, all of the first illuminating element 321, the second illuminating element 322 and the third illuminating element 323 can be light-emitting diodes (LED). For example, the first illuminating element 321 can be a red-light LED, the second illuminating element 322 can be a yellow-light LED, and the third illuminating element 323 can be a blue-light LED. Namely, in this embodiment, the first illuminating element 321, the second illuminating element 322 and the third illuminating element 323 form a combination of red-yellow-blue light with different wave lengths. In some other embodiments, the first illuminating element 321, the second illuminating element 322 and the third illuminating element 323 can be also formed into another combination of red-green-blue light with different wave lengths. In addition, other combinations of different light with different color temperatures are also relevant to this invention.

The universal fixed structure 4 includes a universal head 41 and a magnetic element 42. The universal head 41 is rotationally connected to the universal head connector 111 of the fixed end 11, and the magnetic element 42 fixedly connected to the universal head 41 is used for attracting magnetically a magnetic material. In this embodiment, since the universal head connector 111 is consisted of four clamp fingers and a tightening ring. Practically, when the tightening ring is rotated to expand these four clamp fingers, the universal head 41 can be then plugged into and clamped by these four clamp fingers. At this time, the tightening ring can be rotated to shrink these four clamp fingers so as to clamp firmly the universal head 41, such that the universal head 41 can be fixed to the universal head connector 111 in a manner of universal rotation.

As shown in FIG. 1 and FIG. 6, in this embodiment, the platform 200 can be the metal sheet of the vehicle, and thus the magnetic element 42 can be applied to fix the multipurpose illuminating device 100 of the present invention in a magnetic manner onto the platform 200. Then, the multi-angle bending assembly 31 is applied to adjust the lighting assembly 32, so that at least one of the first illuminating element 321, the second illuminating element 322 and the third illuminating element 323 can be adjusted to irradiate the platform 200 by correspondingly at least one of the first light beam LB1, the second light beam LB2 and the third light beam LB3.

The rechargeable battery 5, coupled electrically with the control module 2, is used for energizing the control module 2. The power detection module 6, coupled electrically with the rechargeable battery 5 and the control module 2, is used for detecting a power storage remained in the rechargeable battery 5 and then generating a corresponding power detection signal S4 to the control module 2. The power display unit 7 is coupled electrically with the control module 2. Then, the control module 2 can evaluate the power detection signal S4 to control the power display unit 7 to display the power storage of the rechargeable battery 5. The charging module 8, disposed at the main body 1 and coupled electrically with the rechargeable battery 5, has a charging port 81 exposed out of the main body 1. In this embodiment, the power display unit 7 provides a plurality of LEDs to display the power storage, and the charging port 81 is a USB connection port.

Referring now to FIG. 1 through FIG. 6, the fixed end 11 of the multipurpose illuminating device for auto detailing 100 can be fixedly connected to a screw connection portion 301 of a machine tool 300 via the screw connector 112. Thereupon, when the machine tool 300 is used to perform detailing on a platform 200, the multipurpose illuminating device for auto detailing 100 fixedly connected to the machine tool 300 via the screw connector 112 firstly rotates the second connector 312 with respect to the first connector 311 so as to extend the second connector 312 in a second direction D2 perpendicular to the first direction D1. Then, the lighting assembly 32 is rotated with respect to the third connector 313 so as to have the third connector 313 to extend in a reverse direction of the first direction D1, such that the first illuminating element 321, the second illuminating element 322 or the third illuminating element 323 of the lighting assembly 32 can project the first light beam LB1, the second light beam LB2 or the third light beam LB3 onto the platform 200. In this embodiment, the platform 200 is the vehicle metal sheet, and the machine tool 300 is a waxing machine. In some other embodiments, the machine tool 300 can be a polisher, a paint sprayer or a wiping machine.

As shown in FIG. 1 and FIG. 6, the fixed end 11 of the multipurpose illuminating device 100 can be also magnetically attached to the platform 200 via the magnetic element 42. In this embodiment, the platform 200 is the vehicle sheet metal with ferromagnetism. Though the magnetic element 42 can be magnetically attached to the platform 200 in this embodiment, yet, in some other embodiments, the platform 200 can be a frame or a wall with ferromagnetism, so that the magnetic element 42 can be used for positioning fixedly the multipurpose illuminating device for auto detailing 100. In addition, the fixed end 11 of the multipurpose illuminating device for auto detailing 100 can also be positioned via vacuum suckers or the like fixtures.

Figure 7:
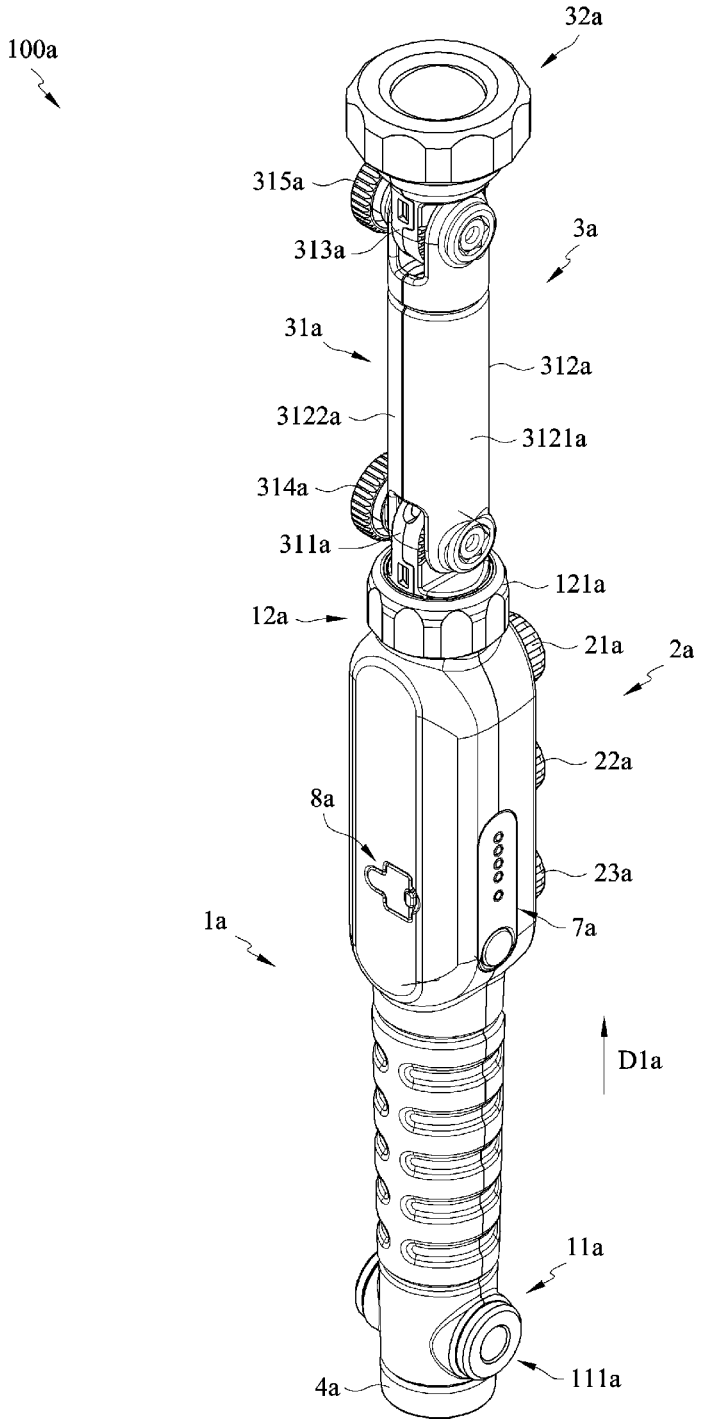
FIG. 7 is a schematic perspective view of a second embodiment of the multipurpose illuminating device for auto detailing in accordance with the present invention.
Figure 8:
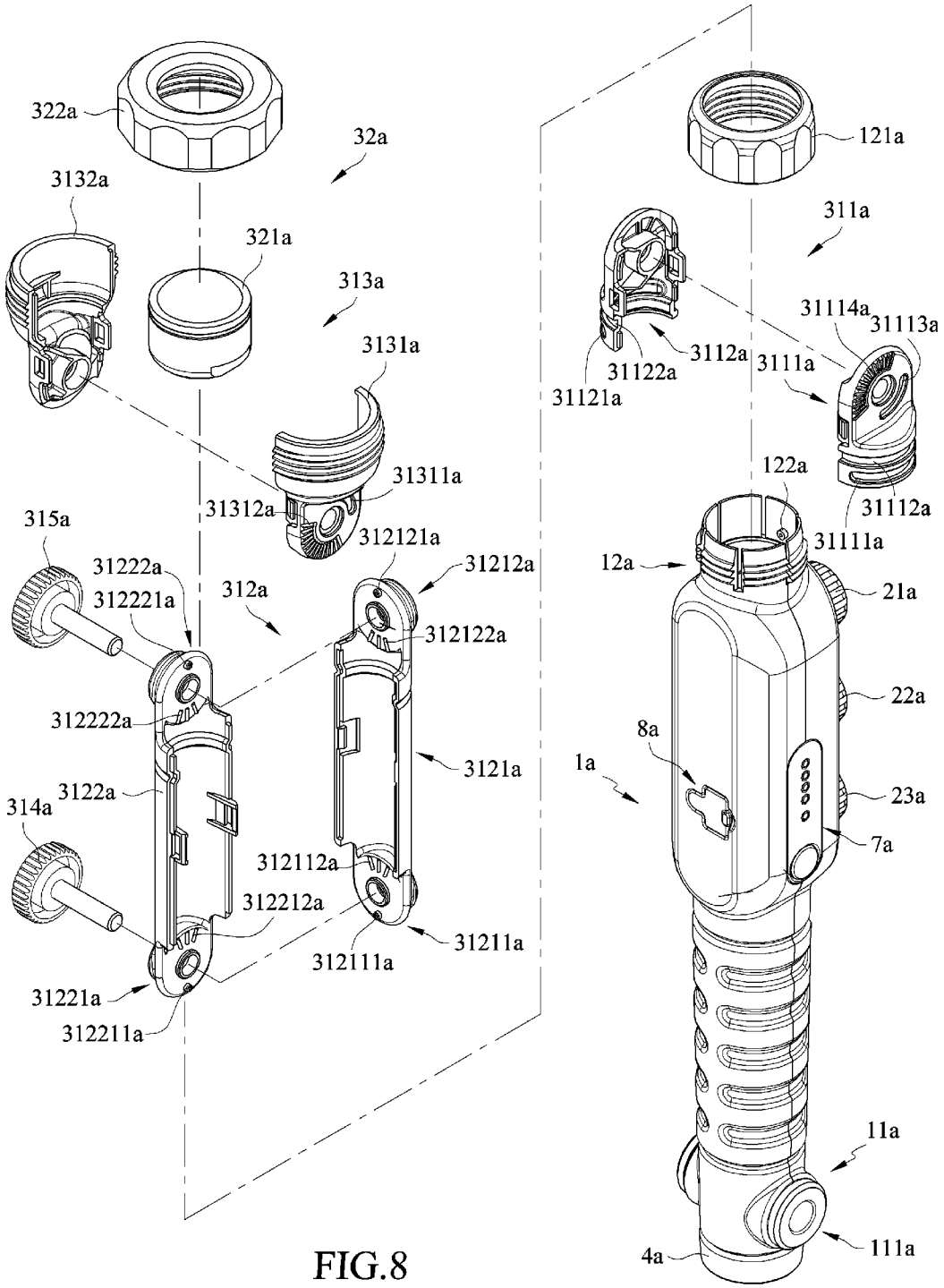
FIG. 8 is a schematic exploded view of FIG. 7.

Refer now to FIG. 7 and FIG. 8; where FIG. 7 is a schematic perspective view of a second embodiment of the multipurpose illuminating device for auto detailing in accordance with the present invention, and FIG. 8 is a schematic exploded view of FIG. 7. As shown in FIG. 7 and FIG. 8, a multipurpose illuminating device for auto detailing 100*a* includes a main body 1*a*, a control module 2*a* and a lighting fixture 3*a*, a magnetic element 4*a*, a rechargeable battery (not shown in the figure), a power detection module (not shown in the figure), a power display unit 7*a* and a charging module 8*a*. The multipurpose illuminating device for auto detailing 100*a* of this embodiment is largely resembled to the multipurpose illuminating device for auto detailing 100 of the previous embodiment, and the difference in between is mainly lay at the structuring. However, the rechargeable battery and the power detection module of this embodiment are the same as the rechargeable battery 5 and the power detection module 6 of the foregoing embodiment, and thus details thereabout are omitted herein.

The main body 1*a* has a fixed end 11*a* and an illumination end 12*a* disposed oppositely with respect to the fixed end 11*a*. The fixed end 11*a* has a screw connector 111*a*. The illumination end 12*a*, extending in a first direction D1*a* from the fixed end 11*a*, has a screw cap 121*a* and two rotation-limiting structures 122*a* (one labeled in the figure only). In addition, the illumination end 12*a* is practically furnished with four longitudinal open slots (not labeled in the figure). With the screw cap 121*a* to engage the illumination end 12*a*, the illumination end 12*a* can clamp fixedly an object (the first connector 311*a*) inserted therein.

The control module 2*a*, disposed at the main body 1*a*, includes a first adjustment switch 21*a*, a second adjustment switch 22*a*, a third adjustment switch 23*a* and a processing unit (not shown in the figure). Since this control module 2*a* is structurally resembled to the aforesaid control module 2, and thus details thereabout are omitted herein.

The lighting fixture 3*a* includes a multi-angle bending assembly 31*a* and a lighting assembly 32*a*. The multi-angle bending assembly 31*a* includes a first connector 311*a*, a second connector 312*a*, a third connector 313*a*, a first angle-adjusting knob 314*a* and a second angle-adjusting knob 315*a*.

The first connector 311*a* is consisted of two first-connector housings 3111*a* and 3112*a*, formed by pairing. The first-connector housing 3111*a* has a first groove 31111*a* and a second groove 31112*a*. As shown, the first groove 31111*a* and the second groove 31112*a*, parallel to each other, are both disposed on a peripheral of the first-connector housing 3111*a*, and each of them has a sealed end (not labeled in the figure) and an open end (not labeled in the figure). However, the sealed end and the open end of the first groove 31111*a* are located in correspondence with the open end and the sealed end of the second groove 31112*a*, respectively. Similarly, the first-connector housing 3112*a* has a first groove 31121*a* and a second groove 31122*a*, and the first groove 31121*a* and the second groove 31122*a* are disposed on a peripheral of the first-connector housing 3112*a* in a parallel manner. Also, each of the first groove 31121*a* and the second groove 31122*a* has a sealed end (not labeled in the figure) and an open end (not labeled in the figure). When the two first-connector housings 3111*a* and 3112*a* are assembled together, the open end of the first groove 31111*a* would connect spatially the open end of the first groove 31121*a* so as to form a peripheral guide structure (not labeled in the figure), and the open end of the second groove 31112*a* would connect spatially the open end of the second groove 31122*a* so as to form another peripheral guide structure (not labeled in the figure). The aforementioned two peripheral guide structures are both C-shape guide structures, but disposed in a reverse manner. In addition, the two rotation-limiting structures 122*a* are individually protruded into the corresponding peripheral guide structures, such that the first connector 311*a* can rotate with respect to the illumination end 12*a*. However, since the two peripheral guide structures are both C-shape guide structures, thus the corresponding allowable angle range of the first connector 311*a* with respect to the illumination end 12*a* would be limited. Thereupon, 360-degree rotation of the first connector 311*a* can be avoided, such that possible fractures at internal wiring due to excessive twisting can be completely waived.

As described above, the first-connector housing 3111*a* further has a first arc guide 31113*a* and a plurality of first swing-positioning grooves 31114*a*. In this embodiment, the first arc guide 31113*a* and the first swing-positioning groove 31114*a* are oppositely disposed around an aperture (not shown in this figure) of the first-connector housing 3111*a*. In addition, the first-connector housing 3112*a* has a first arc guide (not shown in the figure) and a plurality of first swing-positioning grooves (not shown in the figure), similar to the aforesaid first arc guide 31113*a* and the first swing-positioning grooves 31114*a*. Thus, details thereabout are omitted herein.

The second connector 312*a* is consisted of two second-connector housings 3121*a* and 3122*a*, formed by pairing. The second-connector housing 3121*a* has a first-connector end portion 31211*a* and a second-connector end portion 31212*a*. The first-connector end portion 31211*a* has a first swing-limiting structure 312111*a* and three first positioning ribs 312112*a* (one labeled in the figure only). In this embodiment, the first swing-limiting structure 312111*a* and the first positioning ribs 312112*a* (one labeled in the figure only) are oppositely disposed around an aperture (not labeled in the figure) of the first-connector end portion 31211*a*. In addition, the first swing-limiting structure 312111*a* is protruded into the corresponding first arc guide 31113*a*, and the three first positioning ribs 312112*a* are buckled into the corresponding first swing-positioning grooves 31114*a*.

Similarly, the second-connector end portion 31212*a* has a second swing-limiting structure 312121*a* and three second positioning ribs 312122*a* (one labeled in the figure only). In this embodiment, the second swing-limiting structure 312121*a* and the second positioning ribs 312122*a* are oppositely disposed around an aperture (not labeled in the figure) of the second-connector end portion 31212*a*.

As described above, since the second-connector housing 3122*a* has a first-connector end portion 31221*a* and a second-connector end portion 31222*a*, in which the first-connector end portion 31221*a* is symmetrically similar to the first-connector end portion 31211*a*, and the second-connector end portion 31222*a* is symmetrically similar to the second-connector end portion 31212*a*. Thus, details thereabout would be omitted herein. However, it shall be explained that the first swing-limiting structure 312211*a* is protruded into the corresponding first arc guide (not shown in the figure) of the first-connector housing 3112*a*, and the three first positioning ribs 312212*a* are buckled with the corresponding first swing-positioning grooves (not shown in the figure) of the respective first-connector housing 3112*a*.

It shall be explained that, when the second-connector housings 3121*a* and 3122*a* are assembled together, the first-connector end portions 31211*a* and 31221*a* are integrally formed as a first connection end (not labeled in the figure), and the second-connector end portions 31212*a* and 31222*a* are integrally formed into a second-connector end portion (not labeled in the figure).

The third connector 313*a* is consisted of two third-connector housings 3131*a* and 3132*a*, formed by pairing. The third-connector housing 3131*a* has a second arc guide 31311*a* and a plurality of second swing-positioning grooves 31312*a*. In this embodiment, the second arc guide 31311*a* and the second swing-positioning grooves 31312*a* are oppositely disposed around an aperture (not shown in the figure) of the third-connector housing 3131*a*. In addition, the third-connector housing 3132*a* has a second arc guide (not shown in the figure) and a plurality of second swing-positioning grooves (not shown in the figure), similar structurally to the aforesaid second arc guide 31311*a* and second swing-positioning grooves 31312*a*, and thus details thereabout would be omitted herein.

The second swing-limiting structure 312121*a* is protruded into the corresponding second arc guide 31311*a*, and the three second positioning ribs 312122*a* are buckled with the corresponding second swing-positioning grooves 31312*a*. Similarly, the second swing-limiting structure 312221*a* is protruded into the corresponding second arc guide of the third-connector housing 3132*a*, and the three second positioning ribs 312222*a* are buckled with the corresponding second swing-positioning grooves of the third-connector housing 3132*a*.

The first angle-adjusting knob 314*a* is rotationally protruded orderly through the first-connector end portion 31221*a*, the first-connector housing 3112*a*, the first-connector housing 3111*a*, the first-connector end portion 31211*a* and a screw nut (not labeled in the figure). Thereupon, through the screwing engagement between the first angle-adjusting knob 314*a* and the screw nut, the first-connector end portions 31221*a* and 31211*a* can tighten firmly the first-connector housings 3112*a* and 3111*a*.

The second angle-adjusting knob 315*a* is rotationally protruded orderly through the second-connector end portion 31222*a*, the third-connector housing 3132*a*, the third-connector housing 3131*a*, the second-connector end portion 31212*a* and a screw nut (not labeled in the figure). Thereupon, through the screwing engagement between the second angle-adjusting knob 315*a* and the screw nut, the second-connector end portions 31222*a* and 31212*a* can tighten firmly the third-connector housings 3132*a* and 3131*a*.

Since a radial angle of the first arc guide 31113*a* in this embodiment is about 90 degree, thus, when the first angle-adjusting knob 314*a* is loosen, a swing angle of the second connector 312*a* with respect to the first connector 311*a* can be firstly adjusted within the 90-degree range, and then the first angle-adjusting knob 314*a* is turned to shrink the first-connector end portions 31211*a* and 31221*a* for firmly tightening the first-connector housings 3111*a* and 3112*a*. At this time, since the first positioning ribs 312112*a* of the first-connector end portion 31211*a* and the first positioning ribs 312212*a* of the first-connector end portion 31221*a* would buckle the first swing-positioning grooves 31114*a* of the first-connector housing 3111*a* and the first swing-positioning grooves of the first-connector housing 3112*a*, respectively, thus the swing angle between the second connector 312*a* and the first connector 311*a* can be firmly secured.

The lighting assembly 32*a* includes a main lighting-assembly body 321*a* and a fixed cap 322*a*. The main lighting-assembly body 321*a* is disposed between the third-connector housings 3131*a* and 3132*a*. With the fixed cap 322*a* to screw-engage the third connector 313*a*, the main lighting-assembly body 321*a* can be fixed between the third-connector housings 3131*a* and 3132*a*. The lighting assembly 32*a* is resembled to the aforesaid lighting assembly 32. In particular, each of the two lighting assemblies 32, 32*a* has a first illuminating elements (not shown in the figure), a second illuminating element (not shown in the figure) and a third illuminating element (not shown in the figure), and the first illuminating element, the second illuminating element and the third illuminating element are all disposed at the main lighting-assembly body 321*a*. Thus, details thereabout are omitted herein.

As described above, since the lighting assembly 32*a* is fixedly connected to the third connector 313*a*, which is rotationally connected to the second-connector end portion 3122 formed by the second-connector end portions 31212*a* and 31222*a*, thus the lighting assembly 32*a* can swing with respect to the second connector 312*a*. In addition, since the first connection end formed by the first-connector end portions 31211*a* and 31221*a* is rotationally connected to the first connector 311*a*, thus the second connector 312*a* can swing with respect to the main body 1*a*. namely, the lighting assembly 32*a* can swing with respect to the main body 1*a* in a two-section manner.

The magnetic element 4*a*, fixedly connected to fixed end 11*a*, is used for attracting a magnetic material. In addition, the power display unit 7*a* and the charging module 8*a* are structurally resembled to the aforesaid power display unit 7 and charging module 8, respectively, and thus details thereabout would be omitted herein.

Figure 9:
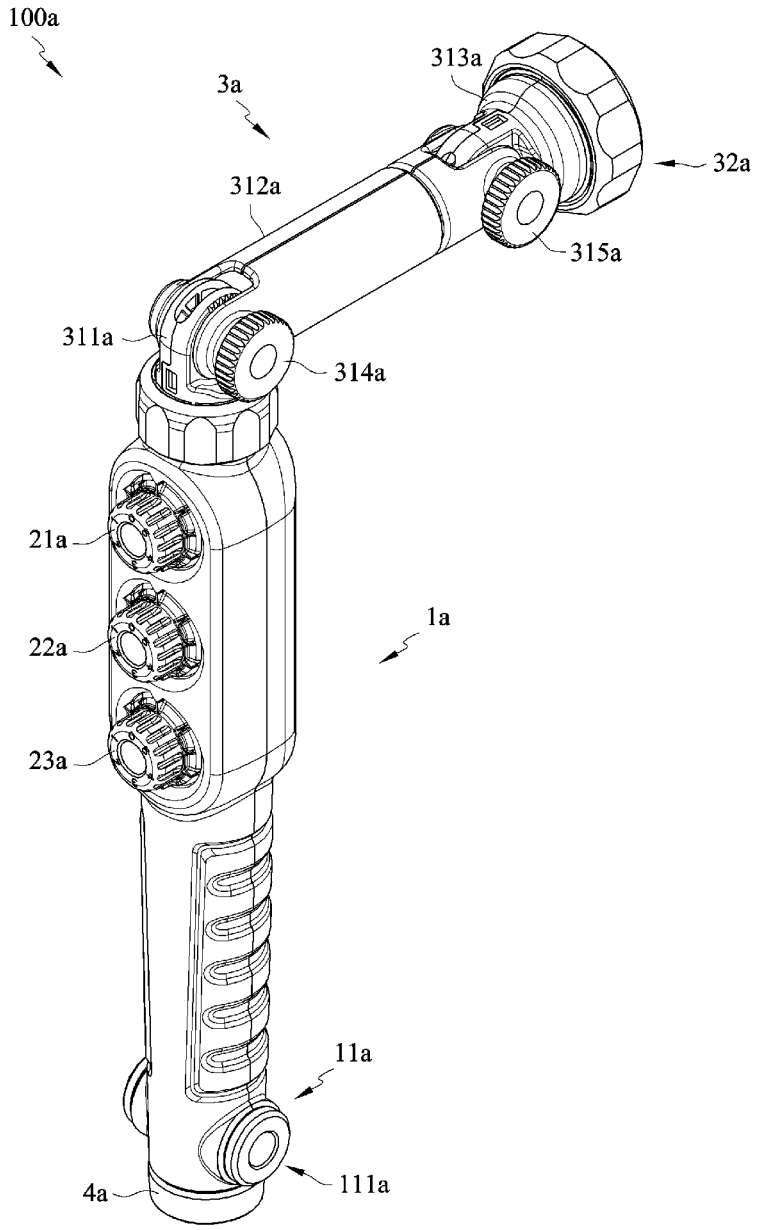
FIG. 9 demonstrates schematically an application state of FIG. 7.
Figure 10:
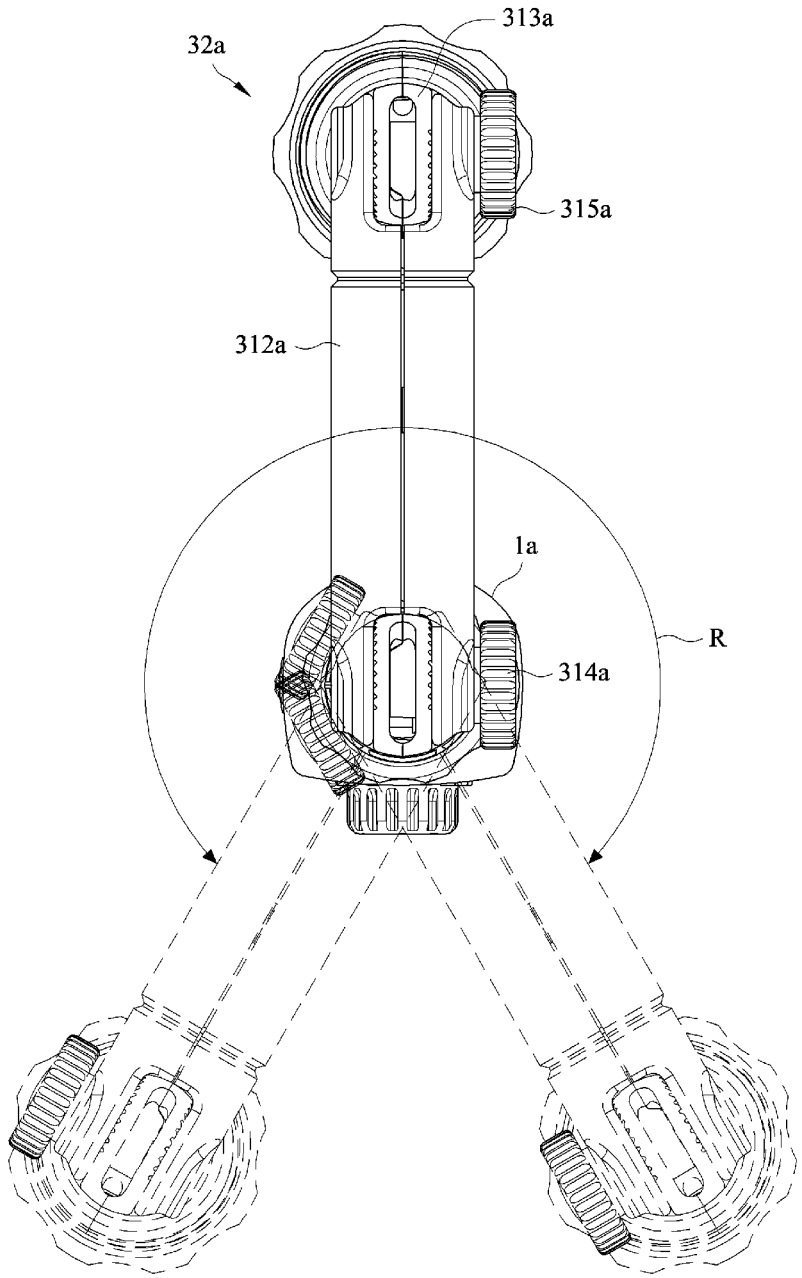
FIG. 10 demonstrates schematically another application state of FIG. 7.

Refer now to FIG. 9 and FIG. 10, where FIG. 9 demonstrates schematically an application state of FIG. 7, while FIG. 10 demonstrates schematically another application state of FIG. 7. As shown in FIG. 7 to FIG. 10, since the first connector 311*a* is rotationally connected to the illumination end 12*a* via the peripheral guide structure formed by the first-connector housings 3111*a* and 3112*a*, thus the lighting assembly 32*a* can have an angular turning range R with respect to the main body 1*a*. In this embodiment, the angular turning range R is defined as the allowable angling range of the peripheral guide structure formed by the first-connector housings 3111*a* and 3112*a*, and is about 300 degree herein.

In summary, in comparison with the existing shortcomings of the art described in the aforesaid background section, the first adjustment switch, the second adjustment switch and the third adjustment switch provided in this invention can control the first illuminating element, the second illuminating element and the third illuminating element, respectively, so as able to adjust the first light intensity of the first light beam, the second light intensity of the second light beam, and the third light intensity of the third light beam for achieving a satisfied working environment with sufficient brightness for auto detailing. In addition, since the fixed end of the multipurpose illuminating device for auto detailing can be fixedly connected to the machine tool or adhered to the platform, thus great convenience for auto detailing can be obtained.

While the present invention has been particularly shown and described with reference to a preferred embodiment, it will be understood by those skilled in the art that various changes in form and detail may be without departing from the spirit and scope of the present invention.

What is claimed is:

1. A multipurpose illuminating device for auto detailing, comprising:

a main body, having a fixed end and an illumination end oppositely disposed to each other, the fixed end being used for fixedly connecting the fixed end to a machine tool or a platform, the illumination end being formed by extending from the fixed end in a first direction;

a control module, disposed at the main body, and including:

a first adjustment switch, used for being adjusted to generate a first strength-adjusting signal;

a second adjustment switch, used for being adjusted to generate a second strength-adjusting signal; and a third adjustment switch, used for being adjusted to generate a third strength-adjusting signal; and a lighting fixture, including:

a multi-angle bending assembly, rotationally fixed to the illumination end; and a lighting assembly, connected with the multi-angle bending assembly and coupled electrically with the control module, including:

a first illuminating element, used for projecting a first light beam, the first light beam having a first luminous field and a first light intensity, the first light intensity being adjusted by the first strength-adjusting signal;

a second illuminating element, used for projecting a second light beam, the second light beam having a second luminous field and a second light intensity, the second luminous field overlapping the first luminous field, the second light intensity being adjusted by the second strength-adjusting signal; and a third illuminating element, used for projecting a third light beam, the third light beam having a third luminous field and a third light intensity, the third luminous field overlapping the first luminous field and the second luminous field, the third light intensity being adjusted by the third strength-adjusting signal.

2. The multipurpose illuminating device for auto detailing of claim 1, wherein the first strength-adjusting signal, the second strength-adjusting signal and the third strength-adjusting signal are all voltage level signals.

3. The multipurpose illuminating device for auto detailing of claim 1, further including a rechargeable battery, the rechargeable battery being coupled electrically with the control module and used for energizing the control module.

4. The multipurpose illuminating device for auto detailing of claim 3, further including a power detection module, wherein the power detection module is coupled electrically with the rechargeable battery and the control module, and used for detecting a power storage of the rechargeable battery and for generating and sending a power detection signal to the control module.

5. The multipurpose illuminating device for auto detailing of claim 4, further including a power display unit, wherein the power display unit is coupled electrically with the control module, and controls the power display unit to display the power storage of the rechargeable battery according to the power detection signal.

6. The multipurpose illuminating device for auto detailing of claim 1, further including a universal fixed structure rotationally connected to the fixed end.

7. The multipurpose illuminating device for auto detailing of claim 6, wherein the universal fixed structure further includes a universal head and a magnetic element, the universal head is rotationally connected to the fixed end, and the magnetic element is fixedly connected to the universal head.

8. The multipurpose illuminating device for auto detailing of claim 7, wherein the fixed end is furnished with a universal head connector, and the universal head is rotationally disposed at the universal head connector.

9. The multipurpose illuminating device for auto detailing of claim 1, further including a magnetic element fixedly connected to the fixed end.

10. The multipurpose illuminating device for auto detailing of claim 1, wherein the multi-angle bending assembly includes:

a first connector, connected with the illumination end of the main body;

a second connector, having a first connection end and a second-connector end portion disposed oppositely to each other, the first connection end being rotationally connected with the first connector; and a third connector, rotationally connected to the second-connector end portion, connected with the lighting assembly.

11. The multipurpose illuminating device for auto detailing of claim 10, wherein the first connector has at least one peripheral guide structure, the illumination end is furnished with a rotation-limiting structure, and the rotation-limiting structure is protruded into the peripheral guide structure to have the first connector able to swing with respect to the illumination end in a limited range.

12. The multipurpose illuminating device for auto detailing of claim 10, wherein the first connector has a first arc guide, the first connection end is furnished with a first swing-limiting structure, and the first swing-limiting structure is protruded into the first arc guide to have the second connector able to swing with respect to the first connector in a limited range.

13. The multipurpose illuminating device for auto detailing of claim 10, wherein the first connector further has a plurality of first swing-positioning grooves, the first connection end is further furnished with at least one first positioning rib, and the at least one first positioning rib is buckled with at least one of the plurality of first swing-positioning grooves.

14. The multipurpose illuminating device for auto detailing of claim 10, wherein the third connector has a second arc guide, the second-connector end portion is furnished with a second swing-limiting structure, and the second swing-limiting structure is protruded into the second arc guide to have the third connector able to swing with respect to the second connector in a limited range.

15. The multipurpose illuminating device for auto detailing of claim 10, wherein the third connector further has a plurality of second swing-positioning grooves, the second-connector end portion is further furnished with at least one second positioning rib, and the at least one second positioning rib is buckled with at least one of the plurality of second swing-positioning grooves.

* * * * *